United States Patent [19]

Corboy, Jr.

[11] 4,441,746

[45] Apr. 10, 1984

[54] TOOL FOR RETRIEVING OUT-OF-REACH OBJECTS

[76] Inventor: Edward D. Corboy, Jr., 710 N. Lake Shore Dr., Apt. 606, Chicago, Ill. 60611

[21] Appl. No.: 336,688

[22] Filed: Jan. 4, 1982

[51] Int. Cl.[3] ..... B25B 5/04

[52] U.S. Cl. ..... 294/19 R; 294/115

[58] Field of Search ..... 294/11, 19 R, 20, 22, 294/50.8, 50.9, 100, 104, 115, 28, 29, 30, 31, 50.6

[56] References Cited

U.S. PATENT DOCUMENTS 3,669,487 6/1972 Roberts et al. ..... 294/19 R

FOREIGN PATENT DOCUMENTS 467296 8/1950 Canada ..... 294/19 R

*Primary Examiner*—James B. Marbert

[57] ABSTRACT

A manually operated, hand held pick up tool or dropped object retrieving device includes an elongated rigid tube having at one end a jaw assembly which includes two movable jaw pieces and two linkage pieces and at the opposite end a handle assembly. The jaw pieces pivot about a pivot bolt attached to the rigid tube. The movable jaw pieces are caused to approach each other in a symmetrical fashion and come into apposition when a sliding handle piece in the handle assembly is squeezed and brought toward a fixed handle in the handle assembly. A centrally placed connecting rod running longitudinally within the rigid tube couples the sliding handle to the linkage pieces of the jaw assembly. A compression spring positioned around the connecting rod within the rigid tube normally maintains the movable jaw pieces in the open position. A magnet is attached to one of the jaw piéces so as to allow retrieval of magnetic metal objects. Soft tips are placed on the ends of the jaws to improve gripping ability of the jaws and also to prevent scratching of the retrieved objects.

9 Claims, 5 Drawing Figures

TOOL FOR RETRIEVING OUT-OF-REACH OBJECTS

BACKGROUND OF THE INVENTION

This invention relates to pick up tools, dropped object retrieving devices, reach extenders or like holding and pick up tools which an operator may use from a standing position or a seated position.

The invention has for its primary object the goal of providing a light weight pick up tool or dropped object retrieving device which is particularly useful and helpful to disabled persons, persons confined to wheel chairs, back pain victims, neck pain victims, post surgical patients who cannot bend or stoop over during their recovery from surgery, pregnant women, arthritis victims, persons involved in picking up pieces of litter and garbage, and healthy people who would rather not stoop over.

This invention is particularly useful to persons who have difficulty in stooping, bending, reaching, twisting, or stretching to retrieve objects and articles that are on the floor or ground. This invention is also useful to help retrieve objects that are beyond the reach of a person's hands and arm span. Bed ridden persons, persons confined to wheel chairs, as well as persons involved in some form of medical treatment therapy such as kidney dialysis or spine traction would also find this invention useful.

Persons recovering from back surgery, neck surgery, eye surgery, plastic surgery, heart surgery, scoliosis correction surgery, abdominal surgery, hip surgery, knee surgery, brain surgery, as well as persons with muscular dystrophy, multiple sclerosis, and other neuro-muscular diseases would find this invention useful and helpful.

A secondary object of this invention is to provide healthy persons with an easy to use pick up aid that will help them minimize the number of times they have to stoop over and bend each day when picking up around and in their homes.

This invention may also be used by persons whose occupations involve picking up and retrieving a lot of small to medium sized articles, such as highway and street clean up crews, gardeners, hotel maids, factory maintenance persons, automobile mechanics, and various other occupations. Fruit pickers could use this invention for picking fruit off hard to reach branches as well as for shaking fruit off branches. Skin divers and scuba divers could use this invention for catching crabs as well as obtaining and handling possibly poisonous and dangerous undersea plants or animals. Persons involved in arranging store front window displays would find this invention useful and helpful in positioning and adjusting items in their displays.

It will be appreciated that the invention has a broad range of uses for both disabled and healthy persons alike.

A number of reach-extending devices have been suggested in the prior art. See, for example, U.S. Pat. Nos. 1,694,525, 1,910,725, 2,061,130, 2,807,495, 2,819,110, 3,265,429, 3,276,805, 3,591,226 and 4,037,868, and British Pat. No. 849,366. U.S. Pat. No. 3,265,429 discloses a combination cane and pick-up tool having a hand actuating function somewhat similar to that of the present invention. Also, this and several others of the above patents show tension type connecting rods with spring biasing mechanisms generally similar to that of the present invention. However, all of the above patents fail to contemplate many of the important features of this invention. The patents cited above in particular all show jaw mechanisms wherein only one jaw member moves to effect the grasping action.

SUMMARY OF THE INVENTION

The pick up tool of the invention provides for the combination of a movable jaw assembly with a magnetic mode of object retrieval. The two movable jaws, which are actuated by manual squeezing of a sliding handle in the handle assembly, provide a satisfactory and functional mechanical device that will grasp and hold a wide variety of small to medium sized objects and articles such that they may be picked up off the floor or ground.

The retrieving device of the invention includes soft rubbery or vinyl tips on the jaws for adequate friction in grasping small objects off a surface. The jaws preferably are curved, i.e. bowed outwardly above the tips, and this part of the jaws may be used for retrieving larger, wider objects such as soft drinks and beer cans. These surfaces of jaws may also be vinyl covered for positive gripping action.

The jaw assembly preferably works generally in the manner of a pair of ice tongs, so that upward pull on a pair of links above the jaws is effective to close the jaws. The pull is applied by a connecting rod extending through a tube or housing of the tool. At the upper end of the tool, a handle assembly has a movable piece connected to the top of the connecting rod, for gripping by the palm and fingers to close the jaws, so arranged that a minimum of strength is required for a tight grip with the jaws.

It is therefore among the objects of the invention to improve on previous reach extenders and retrieving devices, providing a tool which will easily grasp small or larger objects, requiring a minimum of force applied by the user. Another object is to avoid complex mechanisms and assembly. These and other objects, advantages, features and characteristics of the invention will be apparent from the following description of a preferred embodiment, considered along with the accompanying drawing.

DETAILED DESCRIPTION OF A PREFERRED EMBODIMENT

Figure 1:
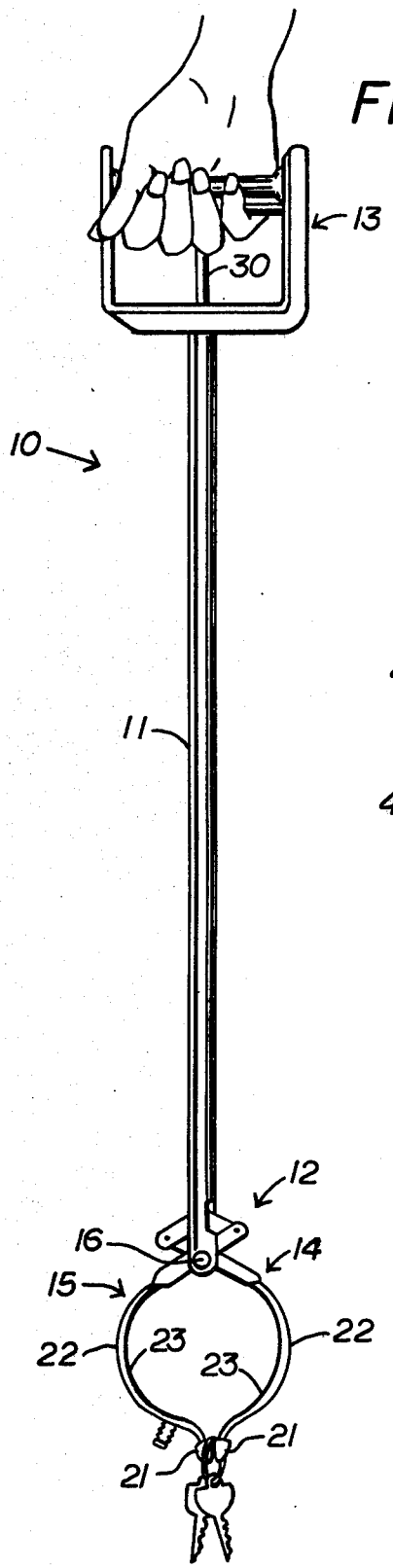
FIG. 1 is a perspective view of a pick up tool according to the invention, being used to retrieve a dropped object.
Figure 2:
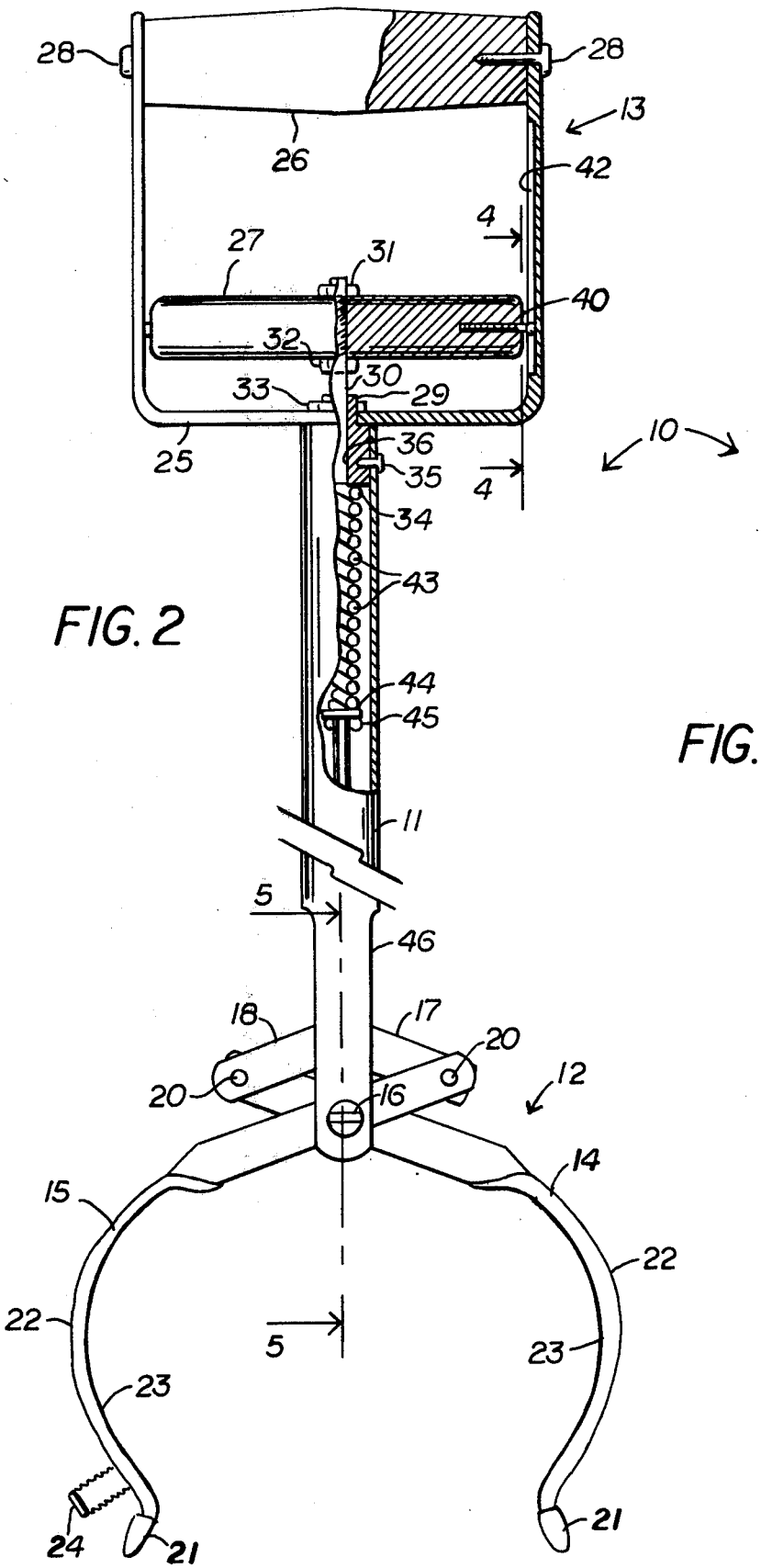
FIG. 2 is a front elevational view, partially in section, of the pick up tool of the invention with jaws in the normal open position, with a portion of the tool's length removed.
Figure 3:
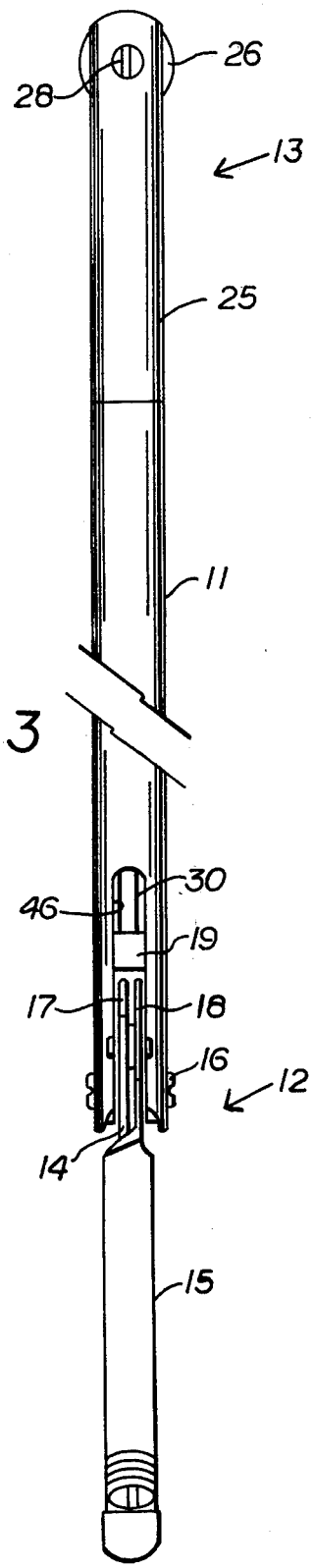
FIG. 3 is a side elevational view of the tool.

Referring initially to FIGS. 1, 2 and 3, there is shown a pick up tool or dropped object retrieving device 10 which includes an elongated, rigid tube 11 made preferably of extruded aluminum. At one end of the tube 11 is a jaw assembly 12 and at the opposite end of the tube 11 is a handle assembly 13. The tool 10 can be of any desired length, depending on use. In FIG. 1 the tool is shown being used to pick up an object from the ground or floor.

The jaw assembly 12 includes two jaw pieces 14 and 15 which are shown in their open position. The two jaw pieces are attached to the elongated, rigid tube 11 by means of a pivot rod or bolt 16. Both jaw pieces 14 and 15 pivot about the pivot bolt 16 when the jaw pieces close together toward the midline.

Figure 5:
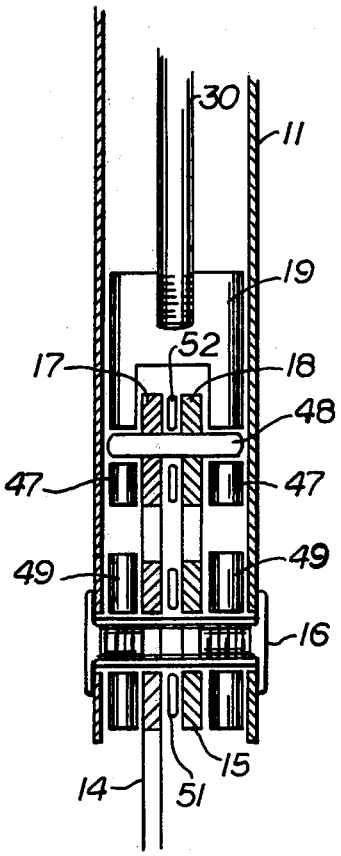
FIG. 5 is an elevational sectional view of the jaw assembly and jaw linkage, taken along the line 5—5 in FIG. 2.

Two linkage pieces 17 and 18 link the two jaw pieces 14 and 15 to a linkage insert piece 19 (see FIG. 3, and also FIG. 5). The jaw piece 14 is linked to the linkage piece 18 by a fastener 20 such as a rivet, and the jaw piece 15 is linked to the linkage piece 17 by a similar fastener.

The two jaw pieces 14 and 15 and the two linkage pieces 17 and 18 preferably are made of aluminum flat ribbon stock.

Both jaw pieces 14 and 15 preferably have soft vinyl or rubber-like tips 21 inserted over them, for better gripping and retention of an object between them. These tip coverings 21 may be removed if desired, as for outdoor use where objects to be picked up may have rough surfaces. The surface of the jaw face itself may be textured or roughened for better gripping in such circumstances.

Curved portions 22 of the jaws may also have a soft coating 23 of similar vinyl or rubber-like high-friction material on their inside surfaces, so that larger objects can be gripped between these portions of the jaws. The jaws 14 and 15 may be formed of flat aluminum stock twisted through 90° at points 22*a*, at the tops of the curved portions 22.

A strong permanent magnet 24 is secured to one of jaw pieces 14 or 15 by suitable fasteners or glue, for picking up magnetic metal objects. The magnet 24 preferably is of five pounds or greater gripping force.

The handle assembly 13 contains a formed handle piece 25, preferably of aluminum, that acts as a rigid handle frame. Within this aluminum handle piece 25 is a fixed handle piece 26 made of wood or plastic, for engagement by the palm, and a sliding handle piece 27, also made of wood or plastic, for gripping by the fingers to pull it toward the fixed piece. The fixed handle piece 26 may be shaped as indicated for comfort and stability in engagement by the palm. The arrangement of the fixed and sliding handle components 26 and 27 takes advantage of the gripping strength of the hand, as between the four fingers and the palm. Only small squeezing force need be applied to the handle to effect a relatively large grasping force at the tips 21 of the jaws 14 and 15.

The fixed handle 26 preferably is held in place by two screws 28, which pass through the rigid handle frame 25.

The sliding handle piece 27 is attached to a connecting rod 30, preferably by two nuts 31 and 32, the end of the rod 30 being threaded. This connecting rod 30 runs longitudinally within the elongated rigid tube 11 and is attached to the linkage insert piece 19 below.

To retain the rigid tube 11 to the handle frame 25, a handle attachment insert 34 is positioned in the top end of the tube 11, with a smaller-diameter threaded end 29 extending up out of the tube and through the handle frame 25. A nut 33 is screwed onto the threaded end 29, holding the handle frame 25 to the rigid tube. A screw 35 passes through a small hole in the side of the tube and into the insert piece 34 to retain the latter rigidly in place.

The handle attachment insert 34 acts as a slide bushing, with a central cylindrical through-hole 36, through which the connecting rod 30 passes, with little clearance. The hole 36 serves to stabilize the handle piece 27 in its movement, and the connecting rod 30 is of relatively large diameter for rigidity, adding further stability. The handle piece 27 is therefore prevented from rocking or twisting, assuring a smooth sliding movement.

FIG. 2 shows further important features of the handle assembly 13. The sliding handle piece 27, rigidly secured to the upper end of the connecting rod 30 by the nuts 31 and 32, is also guided in its sliding movement by interaction with the handle frame 25. Two guide pins 40 extend into the ends of the movable handle 27, protruding outwardly a short distance as indicated. Glue may be applied to the guide pins 40 to prevent rotation in the handle piece 27.

Figure 4:
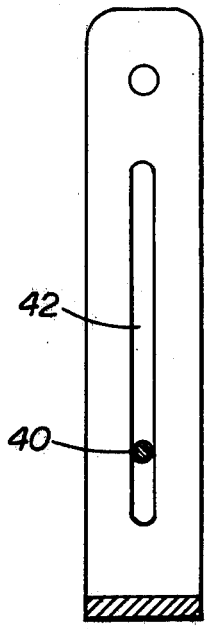
FIG. 4 is a detail view in elevation showing a portion of the handle assembly of the pick up tool, as viewed along the line 4—4 of FIG. 2.

The ends of the pins 40 are positioned in vertically elongated slots 42 in the vertical portions of the handle frame 25. FIGS. 2 and 4 show one of the slots 42, with the end of the pin 40 therein. This further cooperates with the rigid rod 30 and the hole 36 in the insert pieces 34 to provide great stability of the sliding handle 27 in its movement to close the jaw assembly 12. The guide pins and slots serve to closely guide the sliding movement of the handle, preventing tipping and twisting and assuring smooth and low-friction operation.

If desired, and depending on manufacturing tolerances and materials used, the pins 40 can comprise T-shaped guide pins so as to further prevent tipping of the sliding handle piece 27 in the handle frame 25.

As noted above, the tool can be of any suitable length. The length is varied by varying the length of the tube 11 and the connecting rod 30 inside. For wheelchair patients, a shorter length is desirable, whereas ambulatory persons should have a relatively longer length. FIG. 2 shows the tool greatly foreshortened so that the handle assembly and the jaw assembly can be seen in greater detail.

A compression spring 43 positioned over the connecting rod 30 biases the rod 30 and the sliding handle piece 27 toward the normal, lower position shown in FIG. 2, for biasing the jaws toward the open position as shown. At its upper end the spring 43 abuts against the handle attachment insert piece 34 while at its lower end it abuts any suitable structure fixed to the rod, such as a washer 44 and a raised two-ear swedge 45 formed into the connecting rod.

FIG. 3 is a side elevational view of the invention. This view shows the handle assembly 13 with the handle frame 25 and the fixed handle piece 26 held in the handle frame by screws 28, the elongated, rigid tube 11, extending from the handle assembly 13, and the jaw assembly 12 at the lower end of the tube 11.

The jaw assembly 12 is best understood with reference to FIGS. 2, 3 and 5. A milled or stamped out slot 46 in both sides of the elongated, rigid tube 11 (FIG. 3) forms a clevis-like configuration, receiving the jaw pieces 14 and 15 and facilitating their pivoting movement about the pivot pin or bolt 16. The bottom of the tube 11, on both sides of the slot, is rounded and smoth for appearance and safety. The linkage insert piece 19, which preferably is retained by threaded connection to the lower end of the connecting rod 30 (FIG. 5) is clevised, with a pair of flanges 47 having exterior surfaces preferably contoured to the interior surface of the tube 11, i.e. cylindrical, for guided sliding action therein. A dowel pin 48 connects the linkage members 17 and 18 to the flanges 47 of the linkage insert piece. When the slidable handle 27 is pulled, raising the linkage insert piece 19 in the tube 11, the linkage members 17 and 18 are pulled upwardly and close the jaws, generally in the manner of a pair of ice tongs, with the jaw pieces 14 and 15 pivoting about the bolt 16. Jaw stabilizing shims 49, again having generally cylindrical exteriors conforming to the inner surface of the tube 11, are included about the bolt 16 to provide the proper space for receiving the jaw pieces 14 and 15, with a washer 51 between them. A similar washer 52 preferably is positioned on the dowel pin 48, between the linkage members 17 and 18, and both washers may be of nylon or other suitable low-friction material. The linkage piece 19 and shims 49 may be of the same low-friction material.

The retrieving device of the invention is operated by grasping the handle assembly with one hand, and positioning the desired object of retrieval between the tips 21 and the two jaw pieces 14 and 15. The sliding handle 27 is then squeezed toward the fixed handle 26, taking advantage of one of the strongest movements of which the hand is capable. This causes the jaw pieces to close toward each other and eventually the object of retrieval is pinched or held between the jaw tips 21, or between the curved portions 22 of the jaws, for larger objects. The object held by the jaws may now be brought up to the user's other hand or put on a table, avoiding the need to stoop over.

The invention may be used from a standing, walking, or seated position.

Upon release of the squeeze force on the handle, the jaws 14 and 15 open and return to their normal position under the force of the compression spring 43 mounted about the connecting rod 30.

To use the magnet 24 to retrieve an out of reach metallic object, the user holds the handle assembly and directs the jaw 15 with the magnet 29 attached, into contact with the desired object.

The retrieving device 10 preferably is constructed primarily of aluminum, and aircraft quality 6061-T6 aluminum is preferred because of its light weight and strength. The handle pieces 26 and 27 may be of wood or plastic for comfort of the user, and the inserts 34, 19 and 49 as well as washers in the jaw assembly, may be of nylon, teflon or other plastic.

The invention is advantageous over prior art retrieving devices in many important respects. Its design and mechanical movement are simple and relatively trouble-free. The tool is very light in weight, but yet strong and durable. In use, it is nearly friction-free due to the inclusion of nylon or teflon washers and inserts, and the handle arrangement cooperates with the jaw mechanism to provide for a very strong gripping of objects without the need for great force at the handle. Both jaws are movable toward a central closed position, rather than having only one movable jaw piece as in the prior art, making it easier for the user to position the jaws over an object and clench it. This jaw movement is more akin to the manner in which the thumb and fingers naturally grasp an object, than is the prior art single-jaw movement. The soft vinyl tips 21 greatly aid in gripping objects.

In the handle assembly, the heavy connecting rod 30 cooperates with the slide bushing insert piece 34 and the slide guide arrangement in the handle including the rods 40 and slots 42 to assure a smooth, trouble-free handle movement.

The invention provides for both gripping of objects and pick-up of magnetic metal objects with a strong magnet, adding further convenience of use.

The preferred embodiment described herein is intended to be purely illustrative, and not limiting of the scope of the invention. Other embodiments and variations will be apparent to those skilled in the art and may be made without departing from the essence and scope of the invention as defined in the following claims.

I claim:

1. A tool for retrieving out-of-reach objects, comprising:

an elongated, rigid tube having a slot in its lower end, forming a clevis;

a handle assembly and means securing it to the upper end of the tube, including a fixed handle piece engageable by the palm of a user and a movable handle piece engageable by the fingers of the user, movable toward the fixed handle piece;

a connecting rod within the elongated tube, connected at its upper end to the movable handle piece;

a jaw assembly connected at the lower end of the elongated tube, including a pair of movable jaws and means connecting the jaws to the lower end of the connecting rod such that upward movement of the movable handle piece and the connecting rod causes the jaws to converge centrally toward each other, toward a closed, central position, the jaws each including tips at their lower ends and curved, bowed-out portions above the tips, so that small objects can be engaged between the tips, and larger objects can be engaged between the curved portions; and spring means urging the jaws toward a normal, open position, and the connecting rod and movable handle piece downwardly;

whereby movement of the movable handle piece toward the fixed handle piece, by squeezing movement of the user's hand, effects a closing of the jaws to engage an object to be retrieved.

2. The tool of claim 1, further including a magnet attached to one jaw and positioned for engagement of magnetic metal objects for their retrieval.

3. The tool of claim 1, wherein the jaws tips include removable soft high-friction coverings.

4. A tool for retrieving out-of-reach objects, comprising:

an elongated, rigid tube having a slot in its lower end, forming a clevis;

a handle assembly and means securing it to the upper end of the tube, including a fixed handle piece engageable by the palm of a user and a movable handle piece engageable by the fingers of the user, movable toward the fixed handle piece;

a connecting rod within the elongated tube, connected at its upper end to the movable handle piece;

a jaw assembly connected at the lower end of the elongated tube, including a pair of movable jaws and means connecting the jaws to the lower end of the connecting rod such that upward movement of the movable handle piece and the connecting rod causes the jaws to converge centrally toward each other, toward a closed, central position, said connecting means comprising a pivot rod near the lower end of the tube, through the clevis, the jaws having upper extensions that cross at the location of the pivot rod, with the pivot rod passing through them, a pair of linkage pieces, each pivotally connected to the end of the jaw extensions and oriented angularly upwardly and inwardly toward one another from the jaw extensions, the linkage pieces having upper ends connected to the connecting rod such that upward movement of the connecting rod raises the linkage pieces and pulls the ends of the jaw extensions inwardly to close the jaws, generally in the manner of a pair of ice tongs; and spring means urging the jaws toward a normal, open position, and the connecting rod and movable handle piece downwardly;

whereby movement of the movable handle piece toward the fixed handle piece, by squeezing movement of the user's hand, effects a closing of the jaws to engage an object to be retrieved.

5. The tool of claim 4, including a linkage insert piece secured to the lower end of the connecting rod and having a clevised lower end to which the upper ends of the linkage pieces are pivotally secured.

6. A tool for retrieving out-of reach objects, comprising:

a elongated, rigid tube having a slot in its lower end, forming a clevis;

a handle assembly and means securing it to the upper end of the tube, including a fixed handle piece engageable by the palm of a user, and a movable handle piece engageable by the fingers of the user, movable toward the fixed handle piece, the movable handle piece of the handle assembly being generally transverse to the connecting rod and movable slidably, linearly toward the fixed handle piece, and sufficiently wide to receive the four fingers of the user;

a connecting rod within the elongated tube, connected at its upper end to the movable handle piece;

a jaw assembly connected at the lower end of the elongated tube, including a pair of movable jaws and means connecting the jaws to the lower end of the connecting rod such that upward movement of the movable handle piece and the connecting rod causes the jaws to converge centrally toward each other, toward a closed, central position; and spring means urging the jaws toward a normal, open position, and the connecting rod and movable handle piece downwardly;

whereby movement of the movable hand piece toward the fixed handle piece, by squeezing movement of the user's hand, effects a closing of the jaws to engage an object to be retrieved.

7. The tool of claim 6, wherein the handle assembly includes slide guides comprising rods extending from each end of the movable handle piece and into slots formed in vertical portions of the handle assembly.

8. The tool of claim 6 or 7, further including a handle attachment insert piece secured to both the handle assembly and to the elongated tube, serving as said securing means, the insert piece having a central longitudinal bore through which the connecting rod passes, with little clearance, acting as a slide bushing and helping assure stability and smooth sliding of the movable handle piece.

9. The tool of claim 6, wherein the spring means comprises a compression spring fitted over the connecting rod, with abutment means on the rod against which the lower end of the spring presses, the upper end of the spring being engaged against the handle assembly securing means at the upper end of the elongated tube.

* * * * *